US009931269B2

(12) United States Patent
Mansur, Jr. et al.

(10) Patent No.: US 9,931,269 B2
(45) Date of Patent: Apr. 3, 2018

(54) AIR PUMP FOR USE IN INTERMITTENT PNEUMATIC COMPRESSION THERAPY HAVING A DIGITAL DISPLAY

(71) Applicant: Compression Therapy Concepts, Inc., Eatontown, NJ (US)

(72) Inventors: Orlando Mansur, Jr., Eatontown, NJ (US); Leonard Nass, Eatontown, NJ (US)

(73) Assignee: Compression Therapy Concepts, Inc., Eatontown, NJ (US)

( * ) Notice: Subject to any disclaimer, the term of this patent is extended or adjusted under 35 U.S.C. 154(b) by 367 days.

(21) Appl. No.: 14/216,290

(22) Filed: Mar. 17, 2014

(65) Prior Publication Data

US 2014/0276291 A1 Sep. 18, 2014

Related U.S. Application Data

(60) Provisional application No. 61/800,357, filed on Mar. 15, 2013.

(51) Int. Cl.
*A61H 9/00* (2006.01)

(52) U.S. Cl.
CPC ... *A61H 9/0078* (2013.01); *A61H 2201/0157* (2013.01); *A61H 2201/0184* (2013.01); *A61H 2201/164* (2013.01); *A61H 2201/165* (2013.01); *A61H 2201/1635* (2013.01); *A61H 2201/5002* (2013.01); *A61H 2201/5007* (2013.01); *A61H 2201/5071* (2013.01); *A61H 2209/00* (2013.01)

(58) Field of Classification Search
CPC ..... A61H 9/0078–9/0092; A61H 2201/0103; A61H 2201/165; A61H 2201/5058; A61H 2205/106; A61H 2209/00
See application file for complete search history.

(56) References Cited

U.S. PATENT DOCUMENTS

| | | | | |
|---|---|---|---|---|
| 4,197,837 | A * | 4/1980 | Tringali | A61G 7/05776 137/565.27 |
| 5,626,556 | A | 5/1997 | Tobler et al. | |
| 7,871,387 | B2 | 1/2011 | Tordella et al. | |
| 2004/0111048 | A1* | 6/2004 | Jensen | A61F 5/0111 602/13 |
| 2005/0070828 | A1 | 3/2005 | Hampson | |
| 2005/0075531 | A1* | 4/2005 | Loeb | A61H 9/0078 600/17 |

(Continued)

*Primary Examiner* — Rachel T Sippel
(74) *Attorney, Agent, or Firm* — Schewgman Lundberg & Woessner, P.A.

(57) ABSTRACT

A digital display air pump includes a rectangular, box-shaped body having a standard AC power cord extending from it, two air supply output ports, and a control and information panel located on its front side with user-operated buttons, a digital display for showing air pressure and alarm codes, a variable air pressure set dial, and status lights. Within the hollow interior of the body is an air compressor, a dual-output electromechanical valve having to two air output tubes, an air pressure sensor, an AC power connection, an internal loudspeaker, and an electronic circuit board controlling the digital display air pump's function. The air supply output ports, an extension of the air tubes within the body, supply air to Intermittent Pneumatic Compression ("IPC") Therapy device garments through flexible air supply tubes.

13 Claims, 5 Drawing Sheets

(56) References Cited

U.S. PATENT DOCUMENTS

| | | | | |
|---|---|---|---|---|
| 2008/0245361 | A1 | 10/2008 | Brown | |
| 2008/0249441 | A1 | 10/2008 | Avitable | |
| 2008/0249442 | A1 | 10/2008 | Brown | |
| 2008/0249443 | A1 | 10/2008 | Avitable | |
| 2008/0249444 | A1 | 10/2008 | Avitable | |
| 2008/0249447 | A1 | 10/2008 | Brown | |
| 2008/0249449 | A1 | 10/2008 | Brown | |
| 2008/0249455 | A1 | 10/2008 | Brown | |
| 2010/0268130 | A1* | 10/2010 | Khan | A61H 9/0078 601/46 |
| 2012/0065561 | A1* | 3/2012 | Ballas | A61H 9/0021 601/152 |
| 2012/0209153 | A1* | 8/2012 | Farrow | A61H 9/0092 601/18 |
| 2012/0323152 | A1* | 12/2012 | Schubert | A61H 9/0092 601/149 |

* cited by examiner

AIR PUMP FOR USE IN INTERMITTENT PNEUMATIC COMPRESSION THERAPY HAVING A DIGITAL DISPLAY

RELATED APPLICATION

This application claims the benefit of priority to U.S. Provisional Application No. 61/800,357, filed on Mar. 15, 2013, entitled "Air Pump for use in Intermittent Pneumatic Compression Therapy Having a Digital Display", and currently co-pending.

FIELD OF THE INVENTION

The present invention relates generally to medical and therapy devices. The present invention is more particularly useful as an air pump for use with compression garments in the prevention of deep vein thrombosis. The present invention is particularly useful to prevent deep vein thrombosis during periods of low or no activity to continually circulate blood through a patient's extremities.

BACKGROUND OF THE INVENTION

Deep Vein Thrombosis, or "DVT", is a blood clot ("thrombus") that forms in a vein deep in the body. A thrombus occurs when blood thickens and clumps together. Most of these thrombi occur in the lower leg or thigh; however, they can also occur in other parts of the body. Thrombi located in the thigh are more likely to break off and cause a pulmonary embolism ("PE") than clots in the lower leg or other parts of the body. The clots that form close to the skin usually cannot break off and cause a PE due to their reduced size and the reduced pressures exerted on them.

A DVT, or a portion of it, can break off and travel through the bloodstream where it can enter the lung and block blood flow. This condition is called pulmonary embolism, which is considered to be very serious due to its likelihood of causing damage to the lungs and other organs and can quite possibly lead to death. This condition affects more than 2.5 million Americans each year and is associated with an estimated 50,000 to 200,000 deaths annually.

The venous system is designed to allow for the return of blood to the right side of the heart. Veins are not passive tubes through which blood passes, but are a system that uses muscular compressions, gravity, and inter-venous valves to promote and control the flow of blood through them. The valves are located along the entire length of the vein and ensure that blood only flows in one (1) direction, toward the heart. Blood flow may easily pass through the valve in the direction toward the heart but when pressure is greater above the valve than below, the cusps will come together thereby closing the valve and stopping the flow of blood away from the heart.

The valves consist of two (2) very thin-walled cusps that originate at opposite sides of the vein wall and come together to meet at the midline of the vein. The diameter of the vein is slightly larger just behind a valve where the cusps attach to the vein wall. Due to the larger diameter of the vein and the propensity for blood to collect and stagnate between the valve cusps and the vein wall, thrombi formation in this area is more likely.

The most common causes of DVT are venous stasis, blood vessel wall injury, and hypercoagulability. Venous stasis is the reduction of blood flow, most notably in the areas of venous valves, usually caused by extended periods of inactivity. These periods of inactivity minimize the muscular compressions applied to the veins therefore removing the forces used to propel the blood through the veins. This reduction in flow allows the blood to collect and congeal thereby forming a clot. The conditions that contribute to venous stasis include heart disease, obesity, dehydration, pregnancy, a debilitated or bed-ridden state, stroke, and surgery. Stasis has been known to develop with surgical procedures lasting as little as thirty (30) minutes.

Vessel wall injury can disrupt the lining of the vein thereby removing the natural protections against clotting. The loss of natural protection will increase the chances of clot formation and the subsequent mobilization of the clot that can lead to a PE. Some of the major causes of vessel wall injury are trauma from fractures and burns, infection, punctures of the vein, injection of irritant solutions, susceptibility to DVT, and major surgeries.

Hypercoagulability exists when coagulation outpaces fibrinolysis, which is the body's natural mechanism to inhibit clot formation. When this condition exists, the chances of clot formation, especially in areas of low blood flow, are greatly increased. Some causes of hypercoagulability are trauma, surgery, malignancy, and systemic infection. A typical treatment is the administration of an anticoagulant such as low-molecular-weight heparin.

It is recognized that clots usually develop first in the calf veins and "grow" in the direction of flow in the vein. The clots usually form behind valve pockets where blood flow is lowest. Once a clot forms, it either enlarges until it is enveloped, which causes the coagulation process to stop, or the clot may develop a "tail" which has a high chance of breaking off and becoming mobile where it can enter the pulmonary system and become lodged in the lungs.

In a patient with DVT, the goals are to minimize the risk of PE, limit further clots, and facilitate the resolution of existing clots. If a potential clot is suspected or detected, bed rest is usually recommended to allow for the clot to stabilize and adhere to the vein wall thereby minimizing the chance of the clot becoming mobile where it can travel to the lungs. A more effective preventative measure is ambulation, which is to walk about or move from place to place. Ambulation requires muscle movement. The muscle movement will provide a continuous series of compressions to the veins thereby facilitating the flow of blood. The continuous flow of blood will reduce or eliminate any areas of stasis so clots do not have a chance to form. For people who are confined to a bed or will be immobile for an extended period of time, leg elevation is recommended. This will promote blood return to the heart and will decrease any existing venous congestion.

Graduated compression stockings have also been used to apply pressure to the veins so as to reduce or minimize any areas of low flow in the vein and not allow the collection and coagulation of blood in these low flow areas. The stockings are designed to provide the highest level of compression to the ankle and calf area, with gradually decreasing pressure continuing up the leg. The stockings prevent DVT by augmenting the velocity of venous return from the legs, thereby reducing venous stasis. Typically, stockings are applied before surgery and are worn until the patient is fully able to move on their own. The stockings need to fit properly and be applied correctly. If too tight, they may exert a tourniquet effect, thereby promoting venous stasis, the very problem they intend to prevent. If too loose, the stocking will not provide adequate compression.

Another treatment of DVT involves the use of intermittent pneumatic compression (IPC). IPC can be of benefit to patients deemed to be at risk of deep vein thrombosis during extended periods of inactivity and is an accepted treatment method for preventing blood clots or complications of venous stasis in persons after physical trauma, orthopedic surgery, neurosurgery, or in disabled persons who are unable to walk or mobilize effectively.

An IPC uses an air pump to inflate and deflate airtight sleeves, or garments, wrapped around the leg. The successive inflation and deflations simulate the series of compressions applied to the veins from muscle contractions thereby limiting any stasis that can lead to thrombi formation. This technique is also used to stop blood clots from developing during surgeries that will last for an extended period of time.

In order to deliver proper and safe medical therapy to the patient, the air pump used in IPC systems must have necessary qualities, characteristics, durability and overall performance capabilities. The pump must reliably create a user-specified pressure in the compression sleeve on the patient, and maintain it within a narrow range for a specified time period with minimal variability, in time or pressure, through countless repetitions of inflation and deflation. To avoid issues of medical concern, such as tissue hypoxia or structural damage, the pump must be able to sense over-inflation of the garment beyond the set pressure, and decrease pressure through slight deflation or by signaling the user to make appropriate changes.

Another version of IPC is the Venous Foot Pump which provides an alternative to the traditional thigh or calf compression device. The foot pump mimics the natural effects of walking and weight-bearing on the circulation in the feet and legs through compressions applied to the foot. Certain medical situations exist in which compression therapy may be recommended for both the foot and leg of a patient. As treatment pressures differ between these body parts, the versatility of a pump is increased if it is capable of outputting a range of air pressures.

PE remains the most common preventable cause of death in hospitalized patients. The deaths are most often a complication resulting from the formation of a DVT and the subsequent PE that may result from it.

In light of the above, it would be advantageous to provide a deep vein thrombosis prevention system with an air pump that minimizes the occurrence of deep vein thrombosis formation. It would be further advantageous to provide a deep vein thrombosis prevention system having an air pump that allows medical personnel to customize the compression of limbs being treated to optimize treatments for particular patients. It would be further advantageous to provide a deep vein thrombosis prevention system having an air pump that provides a range of air pressures within a therapeutic spectrum and being able to display the pressure setting to the user for ease of use. It would be further advantageous to provide an air pump for use in intermittent pneumatic therapy that warns the user auditorially and/or visually when situations of potential medical concern arise during pump operation. It would be further advantageous to provide a deep vein thrombosis prevention system having an air pump that is easy to use, relatively easy to manufacture, and comparatively cost efficient.

SUMMARY OF THE INVENTION

The digital display air pump for use in Intermittent Pneumatic Therapy of the present invention includes a rectangular, box-shaped body having a standard AC power cord extending from it, two (2) air supply output ports, and a control and information panel with user-operated buttons, a digital display, and status lights located on its front side. Within the hollow interior of the body is an air compressor, a dual-output electromechanical switching valve having to two (2) air output tubes, an air pressure sensor, an AC power connection, and an electronic circuit board controlling the digital display air pump's function. The air supply output ports and an extension of the air tubes within the body, supply air to Intermittent Pneumatic Compression ("IPC") Therapy device garments through flexible air supply tubes.

The digital display air pump of the present invention is controlled through buttons on the front of the device, which include a power on/off switch, a single garment switch, a dual garment switch, and an air pressure select dial for setting the output air pressure. Powering on the pump by pressing the power toggle switch up illuminates a power status light. Pressing the switch down turns the pump and the light off. The single and dual garment switches allow a user to select whether one (1) or two (2) IPC therapy garments are being used, respectively. Lights next to the corresponding garment switches illuminate to indicate whether the pump will output air to one (1) or two (2) garments. Therapeutic parameters, such as air pressure, vary depending upon whether a foot or a limb (calf, thigh, or arm) is being treated. For example, an air pressure of 40 mmHg may be used when treating a patient's calf while 80 mmHg to 120 mmHg may be necessary for foot compression therapy. The air pressure select dial allows the user to set air output pressure from a minimum level used for limbs and a maximum level used for feet. The set pressure is shown in the digital display.

Status and alarm indicators are also located on the front of the digital display air pump body. An alarm light blinks to signal the user if there is a state of continuous, non-cycling pressure, over pressure, or a state of low or high pressure occurring in the IPC garment. A corresponding alarm code is displayed in the digital display. An input/output port located inside the body of the digital display air pump allows for connection to a computer for servicing, calibration and program mode adjustments.

In use, the IPC therapy garment is worn by a patient on an extremity that is subject to development of thrombosis, particularly deep vein thrombosis, and particularly during surgery or extended periods of inactivity. The deep vein thrombosis prevention garment is wrapped snugly about a patient's leg, for example. The air supply tube is connected to an input port on the garment and to the air supply output port of the digital display air pump of the present invention via industry-standard air tube connectors. The user then presses the power button, and selects for single or dual garment use by pressing the appropriate button (default is dual garment output). Air pressure is set by adjusting the air pressure select dial, which may be locked at the minimum, halfway and maximum settings for convenience. Once activated, the digital display air pump provides a periodic air supply to the garment(s) through the flexible air supply tube(s) leading to an air chamber in the garment(s).

The air pressure is maintained through the flexible air supply tube, and the air filled chamber becomes pressurized to a predetermined pressure, such as 40 mmHg. As the air-filled chamber inflates, it provides additional pressure on the leg or foot of the patient to urge blood flow further upward through the leg or foot.

The inflation of the air-filled chamber, coupled with the valves within the venous structure of the limb, creates a peristaltic force on the veins within the limb being treated. Once the air filled chamber is pressurized to a predetermined pressure, the pressurized air supplied by the digital display air pump of the present invention to the flexible air supply tube is discontinued, and the air filled chamber deflates, returning the deep vein thrombosis prevention garment to its fully un-inflated configuration. In this fully un-inflated configuration, blood flows freely through the limb being treated.

The inflation and deflation timing cycle of the digital display air pump of the present invention is determined by the pressures being utilized, and the speed by which the air chamber of the deep vein thrombosis prevention garment deflates. In order to effectively urge blood flow through deep veins, the timing for the peristaltic effect of the digital display air pump and the garment is approximately one (1) minute; twelve (12) seconds for inflation and 48 seconds for deflation. Air pressures are typically about 40 mmHg for limb treatment and 80-120 mmHg for foot treatment. However, it is to be appreciated variations of these pressure and timing ranges can be made based upon specific medical conditions and treatment situations.

BRIEF DESCRIPTION OF THE DRAWINGS

The nature, objects, and advantages of the present invention will become more apparent to those skilled in the art after considering the following detailed description in connection with the accompanying drawings, in which like reference numerals designate like parts throughout, and wherein.

DETAILED DESCRIPTION OF A PREFERRED EMBODIMENT

Figure 1:
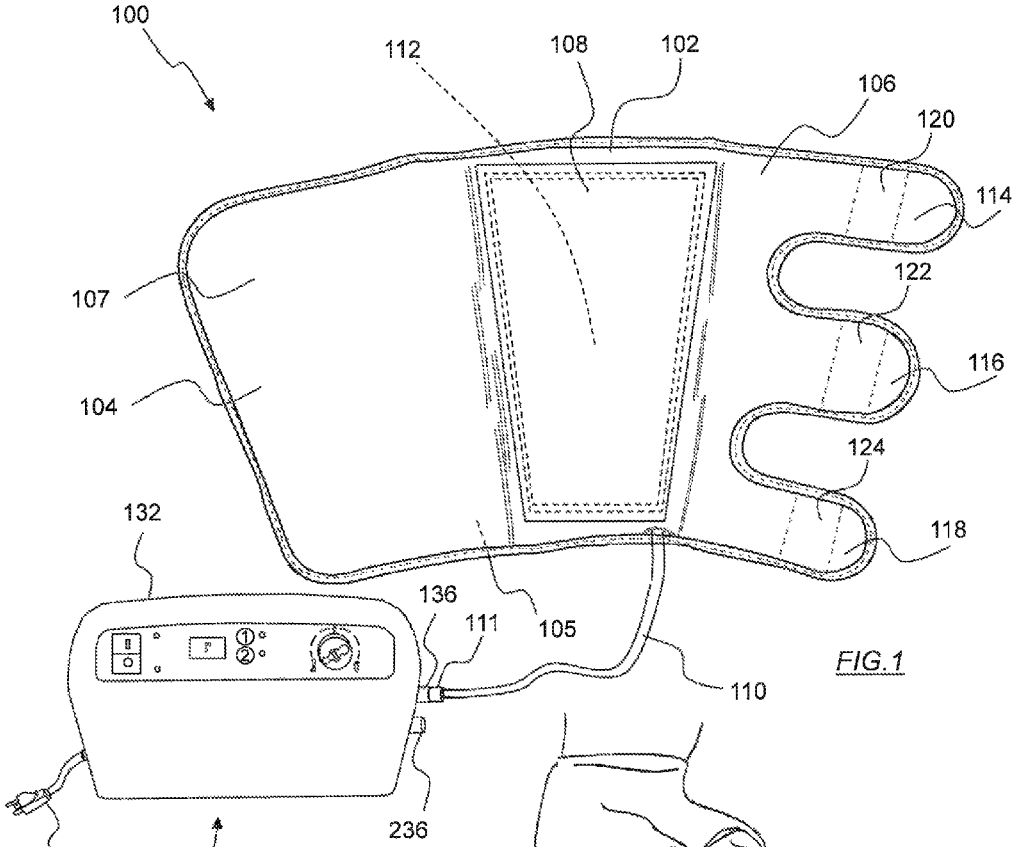
FIG. 1 is a top plan view of the digital display air pump of the present invention showing a pump body having an AC power cord, a control and information panel, and two (2) air output ports, with one port connected to an air chamber (shown in dashed lines) within a deep vein thrombosis prevention garment via a flexible air supply tube.

Referring initially to FIG. 1, a top plan view of the digital display air pump of the present invention is shown and generally designated 130. Digital display air pump 130 includes a body 132, an AC power cord 128, and two (2) air output ports 136 and 236, which are industry-standard quick-disconnect connectors known in the industry to facilitate changing of different devices with the air pump 130. In a preferred embodiment, the digital display air pump 130 of the present invention supplies air through a flexible air supply tube 110 to a deep vein thrombosis prevention garment generally designated 100. Digital display air pump 130 of the present invention is capable of inflating two (2) deep vein thrombosis prevention garments, but only one (1) is shown for clarity in FIG. 1. Garment 100 is representative of a typical garment used in the therapeutic treatment of deep vein thrombosis on a limb of a patient. Garment 100 is made of a flexible material having a back side 105 (shown in dashed line) and a front side 107, and includes a central panel 102, a right side panel 106 and a left side panel 104.

Flexible air supply tube 110 enters central panel 102 and leads to a single air chamber 112 (shown in dashed line) located between central panel 102 and a flexible cover 108. This flexible air supply tube 110 is shown having a non-descript length. It is to be appreciated that the length of the air supply tube 110 may vary depending on the particular field of use, and the setting.

Air supply tube 110 is connected to the air output port 136 of digital display air pump 130 via a mating quick-disconnect connector 111 on the air supply tube 110. Air is supplied to flexible air supply tube 110 from digital display air pump 130 of the present invention. Digital display air pump 130 includes a compressor capable of providing a predetermined maximum air pressure that provides a pressure force to fill the air chamber 112. As will be described in greater detail below, digital display air pump 130 can provide air at a predetermined pressure for a predetermined period of time, providing for an inflation and deflation cycle according to the desired therapy parameters.

As shown in FIG. 1, right side panel 106 of garment 100 is formed with a number of attachment straps 114, 116, and 118, with each strap having an integral fastener 120, 122, and 124, respectively. In common designs within the industry, straps 114, 116, and 118 are provided with the hook portion of a hook-and-loop style fastener 120, 122, and 124. This hook portion of the hook-and-loop fastener cooperates with the outer side 107 of left side panel 104, to allow the deep vein thrombosis prevention garment 100 to be positioned about a patient's limb and secured in place by wrapping the panels 102, 104 and 106 around the limb and pressing the fasteners 120, 122, and 124 on straps 114, 116, and 118 firmly against the outer side 107 of panel 104. The hook-and-loop fasteners attach to the back side of panel 104 to hold the straps 114, 116, and 118 in place.

While the digital display air pump 130 of the present invention in a preferred embodiment is connected to a deep vein thrombosis prevention garment for use on the limb of a patient, it is to be appreciated that, as will be shown in detail later, the digital display air pump 130 is also configured for use on the foot of a patient with corresponding foot-specific garments.

Figure 2:
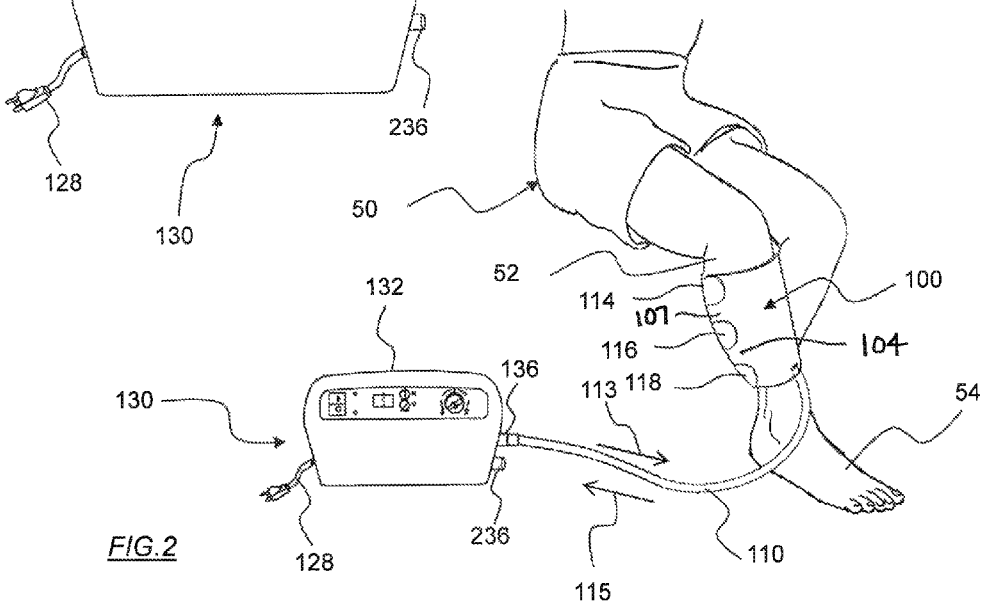
FIG. 2 is a view of the digital display air pump of the present invention being used by a patient for the prevention of deep vein thrombosis, and showing the digital display air pump of the present invention supplying pressurized air through a flexible air supply tube to a deep vein thrombosis prevention garment wrapped around the patient's calf.

Referring now to FIG. 2, the digital display air pump 130 of the present invention is shown being used by a patient 50 for the prevention of deep vein thrombosis. Specifically, as shown deep vein thrombosis prevention garment 100 is positioned around the lower leg 52, or calf, of patient 50 and is in communication with digital display air pump 130 of the present invention through flexible air supply tube 110. Deep vein thrombosis prevention garment 100 is positioned around the calf 52 of patient 50 by positioning panels 102 and 104 against the patient's leg, and then wrapping straps 114, 116, and 118 of panel 106 around the calf 52 and securing the straps to the outer side surface 107 of panel 104 with fasteners 120, 122, and 124 (not shown). Digital display air pump 130 supplies pressurized air through flexible air supply tube 110 to pressurize the air chamber 112 within the deep vein thrombosis prevention garment 100 during periods of inflation and in reverse direction during deflation, shown by directional arrows 113 and 115, respectively. This cyclic pressure of an inflation-deflation cycle, in combination with the inter-venous valves present in the circulatory system, provides a peristaltic force on blood within the limb. The peristaltic force creates the near continual movement of blood within the limb being treated, thereby avoiding the formation of deep vein thrombosis.

FIG. 2 depicts a patient in a sitting position undergoing deep vein thrombosis prevention treatment on one (1) leg. However, this is merely exemplary of the typical use of the digital display air pump 130 of the present invention. Indeed, the digital display air pump 130 of the present invention may be used with the patient 50 virtually in any position. Digital display air pump 130 may also be used, as mentioned, on foot 54 of patient 50 with a foot-specific garment (not shown).

It is also to be appreciated that while FIG. 2 depicts a patient 50 having one (1) deep vein thrombosis prevention garment on a leg, two (2) deep vein thrombosis prevention garments may be used simultaneously, each inflated and deflated by digital display air pump 130 of the present invention. For instance, in a surgery setting, it is commonplace to utilize the digital display air pump of the present invention for treatment on both legs.

Figure 3:
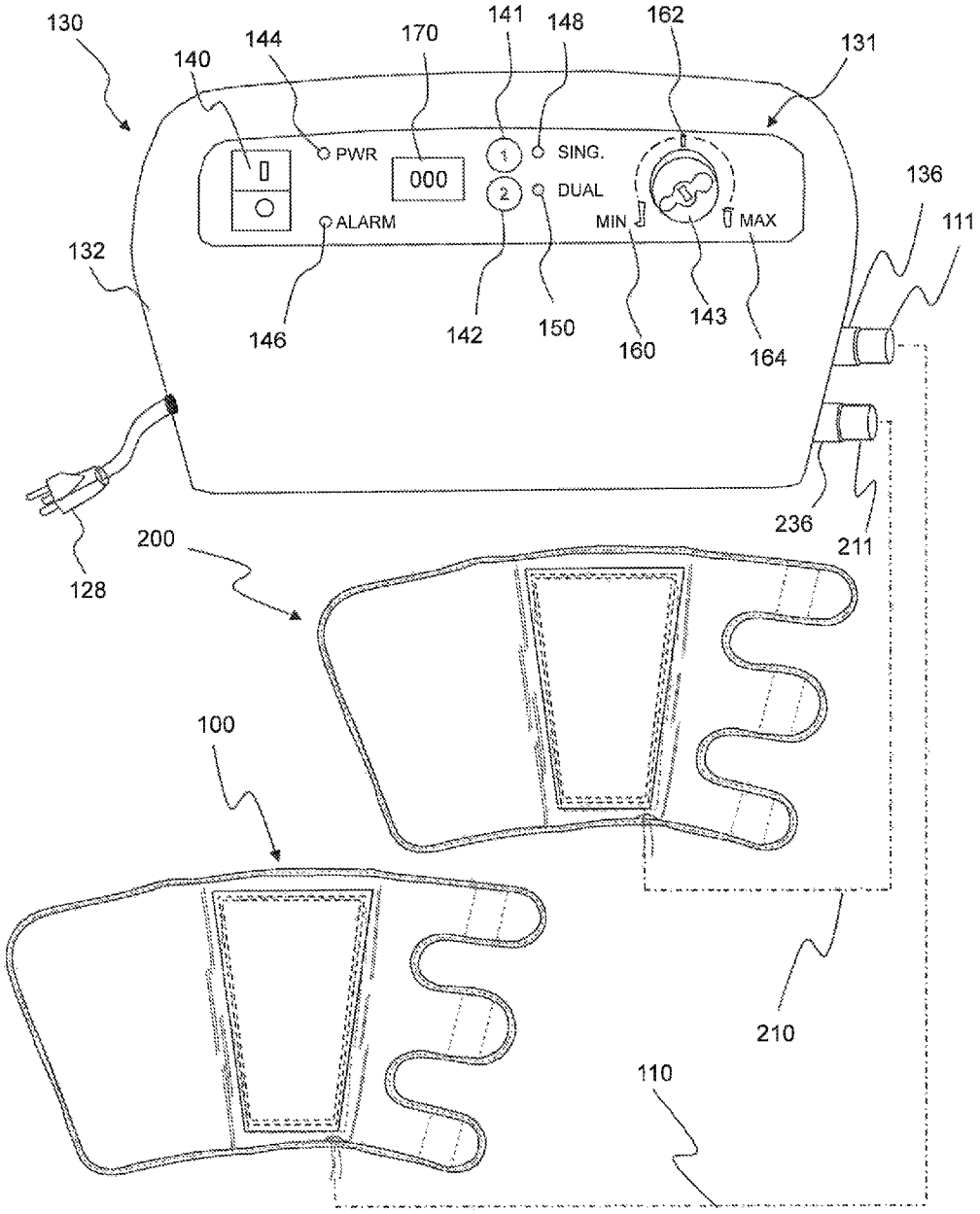
FIG. 3 is a magnified top plan view of the control and information panel on the body of the digital display air pump of the present invention with the digital display air pump connected to two (2) deep vein thrombosis prevention garments via flexible air supply tubes (shown with dashed lines for reference)

Referring now to FIG. 3, a magnified top plan view of the digital display air pump 130 of the present invention connected to two deep vein thrombosis prevention garments, generally designated 100 and 200, by flexible air supply tubes 110 and 210, respectively (shown by dashed lines for reference), is shown. Air supply tubes 110 and 210 attach to air output ports 136 and 236 on body 132 of the digital display air pump 130 of the present invention via mating quick-disconnect connectors 111 and 211, respectively. In FIG. 3, AC power cord 128 on body 132 is shown assumed to be connected to a power source. AC power cord 128 is shown with an arbitrary length, which is not indicative of its application length. A user control and information panel, generally designated 131, is located on the front of body 132 of digital display air pump 130.

Body 132 must be hard, durable, and impact resistant in addition to being inexpensive to manufacture. In a preferred embodiment, body 132 is made of a thermoplastic such as polyvinyl chloride (PVC) or acrylonitrile butadiene styrene (ABS). Both PVC and ABS are tough, impact resistant and relatively inexpensive to manufacture.

Within user control and information panel 131, an on/off power switch 140 turns the digital display air pump 130 of the present invention on and off. When the pump 130 is powered on by toggling power switch 140, a power status light 144 illuminates to alert the user that the device is in operation.

After powering on, the user selects whether one (1) or two (2) deep vein thrombosis prevention garments are connected to the air output ports 136 and 236 of digital display air pump 130 of the present invention by pressing either a single garment switch 141 or a dual garment switch 142. By pressing single garment switch 141 illumination of a single garment mode status light 148 signifies the digital display air pump 130 is in single garment mode, and air is pumped only through air output port 136 to garment 100 via flexible air supply tube 110. If dual garment switch 142 is selected, dual garment status light 150 illuminates to designate the pump 130 is in dual garment mode, and two (2) garments, 100 and 200, are pressurized through air output ports 136 and 236 and air supply tubes 110 and 210, respectively, as is shown in FIG. 3. The default mode is dual garment output.

An air pressure select dial 143 allows the user to set the therapeutic air pressure for inflation of the deep vein thrombosis prevention garments. The air pressure select dial 143 has a continuous range of settings from a minimum pressure setting 160 to a maximum pressure setting 164. The dial may be locked at the three (3) standard pressure settings, minimum setting 160, maximum setting 164 and a mid-range setting 162 for the user's convenience. These three (3) pressure settings, minimum 160, mid-range 162 and maximum 164 are exemplary of common therapeutic air pressures for deep vein thrombosis prevention treatment of a limb/leg, and a foot (low and high pressure), respectively, and range from 40 mmHg (limb) to 120 mmHg (foot). Once set, the selected air pressure is displayed by digital display 170, and operation of digital display air pump 130 begins.

Within the user control and information panel 131 of digital display air pump 130 of the present invention in FIG. 3, an alarm status light 146 is shown. Alarm status light 146 will begin blinking and remain blinking to alert the user to improper system function of the digital display air pump 130, air supply tubes 110 and 210, and deep vein thrombosis prevention garments 100 and 200. An internal audible alarm will sound in tandem with the blinking of alarm status light 146. Digital display 170 displays a specific code for the given alarm situation.

Four (4) alarm states are detected by digital air pump 130: Constant Pressure (CP), Over Pressure (OP), Low Pressure (LP) and High Pressure (HP), and digital display 170 will flash their corresponding codes, CP, OP, LP and HP, respectively. Constant, non-cycling, air pressure (CP) may occur if there is a failure in deflation of deep vein thrombosis prevention garment 100 or 200, thus creating a possible situation of medical concern, as blood stasis and subsequent clotting within the body part being treated can result. Over-pressure (OP) of the garment 100 or 200 results when the air pressure within the system exceeds the preset therapeutic level by a predetermined amount. Excessive air pressure can cause tissue damage in the patient 50. Some possible causes of over-pressure may be failure of air pressure regulation by digital display air pump 130 or external compression of the deep vein thrombosis prevention garment 100 or 200 by the patient 50. Low air pressure (LP) can occur for many reasons, such as air pump 130 failure, a leaking or improperly connected air supply tube, or a leaking compression garment 100 or 200 on the patient 50. High air pressure (HP) may often be a sign of a kinked air supply tube 110 or 210.

It is to be appreciated that the alarm limits for illuminating the alarm status light 146 may vary depending upon which garment type is chosen, as the therapeutic pressures and thus the limits differ between limb and foot treatment options.

Figure 4:
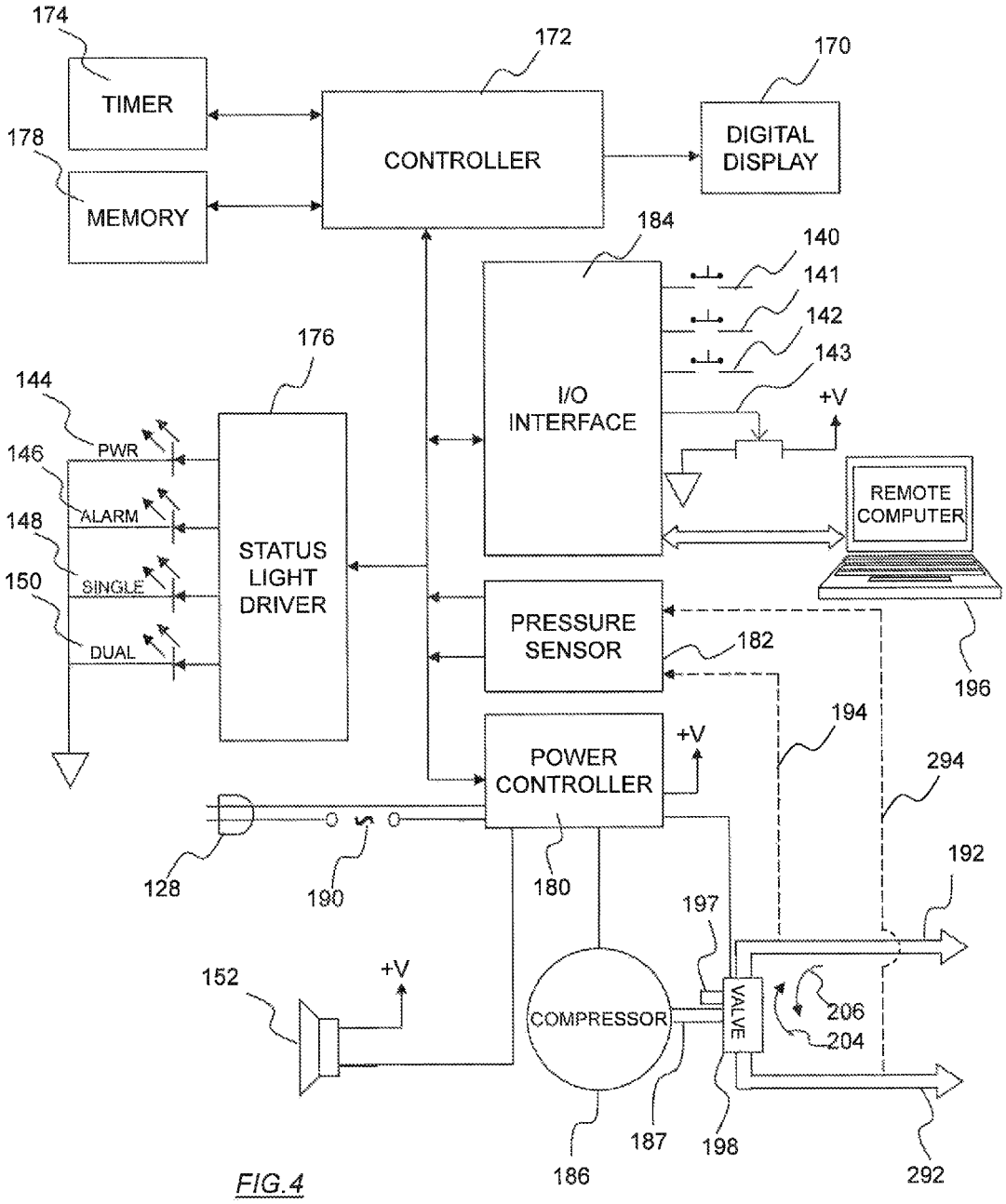
FIG. 4 is an exemplary operational diagram for the digital display air pump of the present invention showing the interconnection and functional relationships between the components, mechanical and electrical.

Referring now to FIG. 4, an exemplary operational diagram of the digital display air pump 130 of the present invention is shown. Air is routed by a dual-output electromechanical switching valve 198 from a single air compressor 186 through a connector air tube 187 and into an air output tube- 1 192 or an air output tube-2 292. Air output tubes 192 and 292 connect to air output ports 136 and 236, respectively (shown in FIGS. 1-3) on body 132 of digital display air pump 130 of the present invention. Air from air output tube-1 192 and air output tube-2 292 is fed back through sensor air tubes 194 and 294, respectively, to a pressure sensor 182 for monitoring.

The digital display air pump 130 of the present invention is powered by an AC power source with AC power cord 128 plugged into an AC electrical outlet. Inline with AC power cord 128 is Fuse 190. Fuse 190 provides over-current protection in the event that digital display air pump 130 suffers an electrical or mechanical failure. Overall power governance is performed by a power controller 180.

Figure 5:
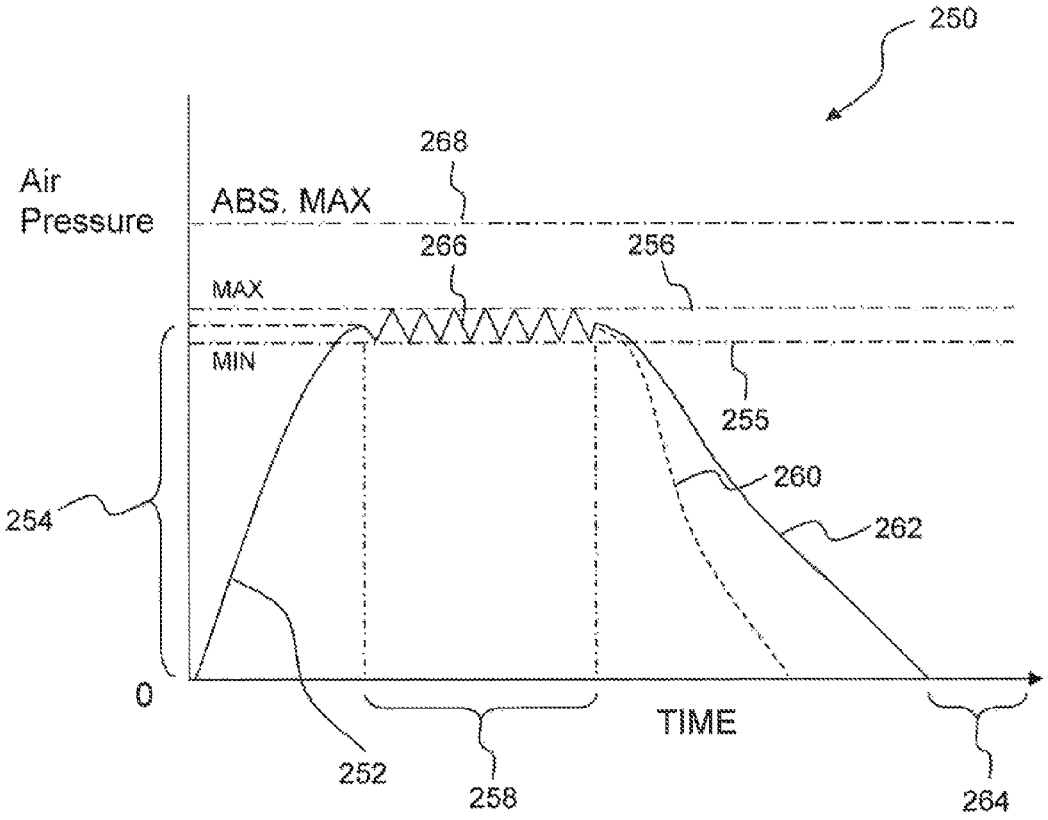
FIG. 5 is a graphical representation of the air pressure supplied from the digital display air pump of the present invention in single-garment mode to one (1) deep vein thrombosis prevention garment, and showing a maximum air pressure to be delivered, and the sequential pressure within the air-filled chamber during an inflation cycle before pressure supplied from the digital display air pump is released and the air-filled chamber deflates.
Figure 6:
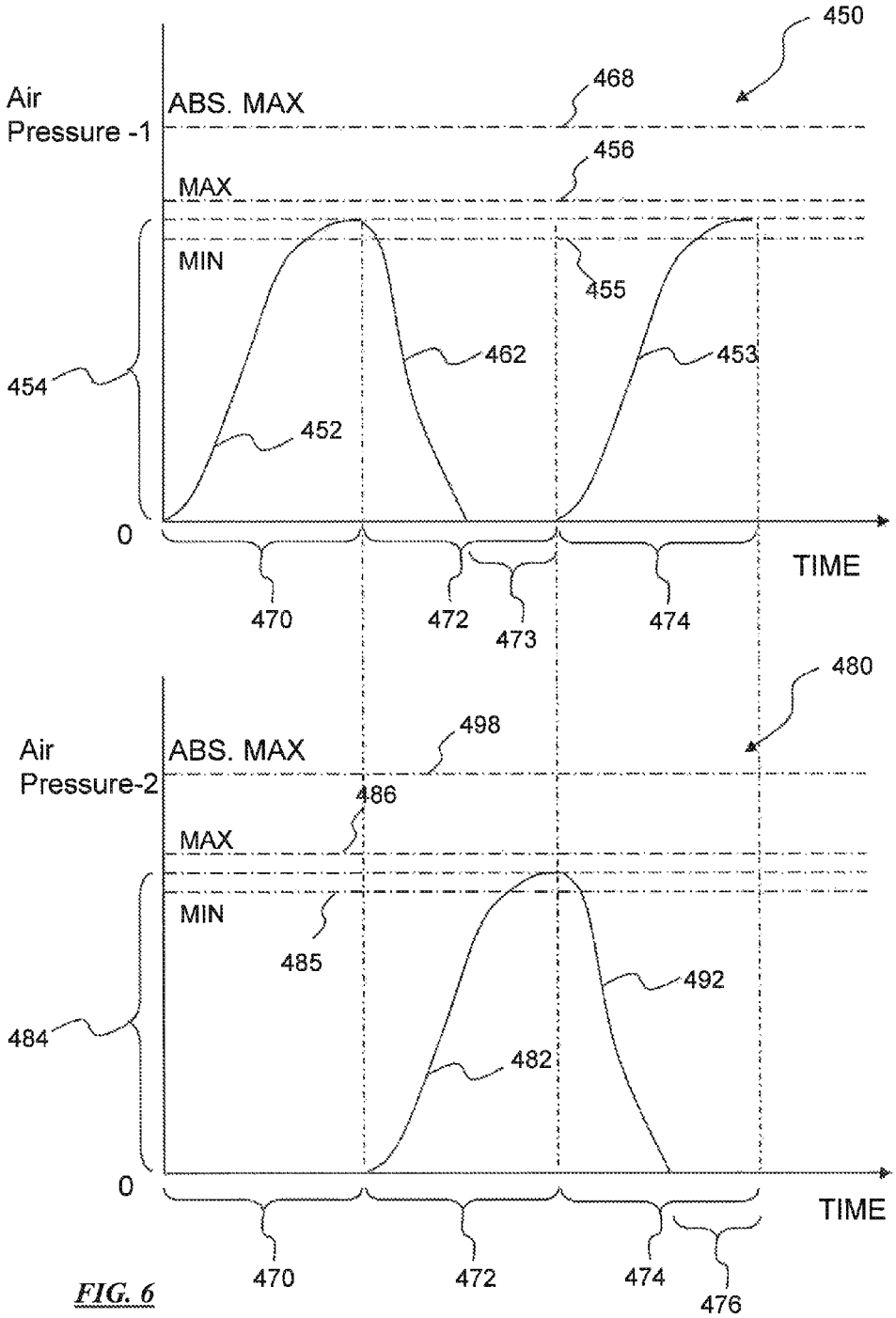
FIG. 6 is a graphical representation of the air pressure supplied from the digital display air pump of the present invention in dual-garment mode to two (2) deep vein thrombosis prevention garments, and showing a maximum air pressure to be delivered, and the sequential and alternating pressures within both air-filled chambers during an inflation cycle before pressure supplied from the digital display air pump is released and the air-filled chambers deflate.

A controller 172 regulates system air pressure and manages inflation/deflation timing of deep vein thrombosis prevention garments 100 and 200 (not shown) through a timer 174, a memory 178, pressure sensor 182, and the power controller 180. Memory 178 stores program information including maximum and minimum air pressure alarm levels as well as timing presets. Timer 174 creates periodicity of inflation/deflation cycles, the duration of inflation and deflation, and the duration of time at which therapeutic air pressure is sustained. FIGS. 5 and 6 will outline the timing cycles in detail.

In a preferred embodiment, controller 172 is a microprocessor with integrated memory and timing functions. Controller 172 also coordinates illumination of LED status lights power 144, single garment mode 148 and dual garment mode 150 through a status light driver 176 based upon user input selection using the power switch 140, single garment switch 141, and dual garment switch 142.

An input/output (I/O) interface 184 directs input from switches 140, 141, 142, and dial 143 to controller 172, and provides input/output access for a remote computer 196 allowing calibration of and program customization changes to pressure and timing settings of the digital display air pump 130 through direct access to memory 178. Memory 178 may also be configured through computer 196 to store real-time usage data such as air pressures and timing points of alarm triggers, for example, over pressure or continuous pressure.

In use, the user presses power button 140 placing the digital display air pump 130 of the present invention in a powered-on state with illumination of power status light 144 through status light driver 176. Next, either single garment switch 141 or dual garment switch 142 is pressed by the user with subsequent illumination of single or dual garment mode status light 148 or 150, respectively, by status light driver 176. If neither switch is selected, the default setting is dual garment mode with illumination of dual garment mode status light 150, and single garment mode status light 148 is turned off. Controller 172 then accesses the appropriate timing parameters from memory 178 for single or dual air output by digital display air pump 130. Timing details are shown in FIGS. 5 and 6. Therapeutic output air pressure is set by air pressure select dial 143, a standard rheostat, through I/O interface 184.

Cycle clocking in timer 174 is initiated followed by signaling of power controller 180 to turn on air compressor 186. Air is pumped from compressor 186 through connector air tube 187 to electromechanical switching valve 198.

In single garment mode, switching valve 198 routes the air to air output tube-1 192 and air output port 136 (shown in FIGS. 1-3) of the digital display air pump 130 of the present invention, which inflates the deep vein thrombosis prevention garment 100 (not shown) via flexible air supply tube 110 (not shown).

Feedback from air tube 192 through sensor air tube 194 to pressure sensor 182 allows controller 172 to compare current system pressure to the programmed therapeutic level stored in memory 178. Controller 172 essentially throttles air compressor 186 through power controller 180 as needed to maintain programmed pressure settings. When an inflation cycle has ended, power controller 180 reduces or cuts power slowing or stopping compressor 186, and air exits the system in reverse direction through air output tube-1 192, and out a dissipation outlet 197 in switching valve 198 until timer 174 clocks the next inflation cycle to begin.

In dual garment mode, switching valve 198 routes air in an alternating manner to the two (2) deep vein thrombosis garments 100 and 200 via air output tube-1 192 and air output tube-2 292, respectively. First, air is routed from air compressor 186 by switching valve 198 to air output tube-1 192 in the same manner as when digital display air pump 130 is in a single garment mode, as described above. At the beginning of deflation of garment 100 (not shown), instead of allowing normal system bleeding of the air in air output tube-1 192 to occur backward through dissipation outlet 197 in switching valve 198, switching valve 198 closes off flow to dissipation outlet 197 and connector air tube 187, while connecting the pressurized air output tube-1 192 with non-pressurized air output tube-2 292. Air flows in direction 206 from air output tube-1 192 into air output tube-2 292. This method allows utilization of the pressurized air from one system (that of garment 100) in deflation mode to assist beginning the inflation of the opposite, un-pressurized system (that of garment 200), helping to achieve a quicker inflation time with decreased power consumption.

When pressure sensor 182 detects approximately equal air pressures in sensor air tubes 194 and 294, or the pressure in the sensor air tubes 194 and 294 reach a level pre-programmed in memory 178, power controller 180 signals switching valve 198 to connect connector air tube 187 to air output tube-2 292 and turns on air compressor 186 to finish inflation of garment 200. Deflation of garment 100 continues through connection of air output tube-1 192 to dissipation outlet 197 in switching valve 198 to complete one cycle of inflation/deflation. The process repeats with garment 200 in the same manner after it achieves maximum inflation, with deflation occurring first through air output tube-2 292 in direction 204, through switching valve 198 and into air output tube-1 192 to assist with the next inflation cycle of garment 100. Inflation/deflation cycling in either single or dual garment mode will continue until the power switch 140 is turned off, or power is interrupted.

During operation of digital display air pump 130, controller 172 compares programmed settings in memory 178 with pressure sensor 182 readings to determine if an alarm state has occurred. If one (1) of the four (4) alarm states occurs, controller 172 signals blinking of alarm status light 146 through status light driver 176, and sounding of an audible notification through internal speaker 152 via power controller 180. Controller 172 also illuminates digital display 170 to show the specific alarm code (CP, OP, LP, HP) for constant pressure, over pressure, low pressure or high pressure, as previously described in FIG. 3.

Referring now to FIG. 5, a graphical representation of the air pressure supplied from the digital display air pump 130 of the present invention to the deep vein thrombosis prevention garment 100 during single garment mode operation is shown and generally designated 250. Graph 250 includes a vertical Air Pressure axis and a horizontal Time axis. This graph 250 depicts a typical inflation and deflation cycle that occurs from the digital display air pump 130 of the present invention when pump 130 is set to pressurize only one (1) deep vein thrombosis prevention garment.

Graph 250 includes a primary supply air pressure curve 252 which corresponds to the air provided by digital display air pump 130 to flexible air supply tube 110 (shown in FIGS. 1-3). This air supply begins at the start of the inflation cycle and rises to a preset, therapeutic air pressure 254. Preset therapeutic air pressure 254 is approximately equal to maximum (MAX) and minimum (MIN) desired therapeutic pressures 256 and 255, respectively (shown by dashed lines). A fluctuating air pressure curve 266 exemplifies how digital display air pump 130 of the present invention maintains preset therapeutic air pressure 254 within this therapeutic range by increasing or decreasing compressor 186 (shown in FIG. 4) air output as needed.

An absolute air pressure (ABS MAX) is an overall maximum pressure 268 (shown by dashed line) that corresponds to an absolute maximum allowed pressure within air chamber 112 (shown in FIG. 1) of the deep vein thrombosis prevention garment 100, the maximum pressure medically safe, or any other maximum value utilized in the art to ensure safe operation of the digital display air pump 130 of the present invention. ABS MAX 268 is the air pressure set point above which the digital display air pump 130 of the present invention signals an alarm of over pressure.

In the digital display air pump 130 of the present invention, the preferred maximum pressure for a deep vein thrombosis prevention garment is 40 mmHg for limb and 80 mmHg for foot treatment. It is to be appreciated, however, that different air pressures may be utilized for differing applications, treatment positions, duration of treatment, and other factors known and considered in the art.

The inflation cycle is completed once the air chamber 112 of deep vein thrombosis prevention garment 100 has had sufficient time to inflate. Following the inflation cycle, a delay 258 may be utilized to maintain a constant pressure on the limb 52 (shown in FIG. 2) to provide time for the blood to flow through the limb. Following any delay, the deflation cycle begins and the pressure 260 in digital display air pump 130 and air supply tube 110 decreases to zero.

As the decrease in pump and supply tube pressure 260 occurs, the pressure 262 in air chamber 112 likewise returns to zero in substantially the same time. Once this inflation and deflation cycle is completed, a delay 264 may be inserted prior to beginning the next inflation and deflation cycle.

Using the digital display air pump 130 of the present invention, the time for a complete inflation cycle, deflation cycle and delay is approximately sixty (60) seconds. It is to be appreciated that the specific period for a complete cycle may be changed depending on the size of the limb or foot being treated, the pressure desired, and the peristaltic forces necessary to minimize the likelihood of the development of a thrombosis.

Referring now to FIG. 6, graphical representations of the air pressure supplied from the digital display air pump 130 of the present invention to deep vein thrombosis prevention garments 100 and 200 during dual garment mode operation are shown and generally designated 450 and 480, respectively. Graphs 450 and 480 include a vertical Air Pressure axis and a horizontal Time axis. These graphs 450 and 480 depict typical inflation and deflation cycles that occur from this embodiment of digital display air pump 130 of the present invention. Specifically, graph 450 depicts the pressure and timing of air supplied by digital display air pump 130 during the inflation/deflation of garment 100, and graph 480 depicts the pressure and timing of the air supplied by digital display air pump 130 during the inflation/deflation of garment 200. Graphs 450 and 480 are placed together for comparison since they share the same timing signature.

Graph 450 includes a primary supply air pressure curve 452 which corresponds to the air provided by air compressor 186 (shown in FIG. 4) of digital display air pump 130 to flexible air supply tube 110 (shown in FIGS. 1-3) via air output tube-1 192 (shown in FIG. 4). This air supply begins at the start of the inflation cycle and rises to a preset, therapeutic air pressure 454. Similarly, graph 480 includes an air pressure curve 482 which corresponds to the air provided by air compressor 186 of digital display air pump 130 to flexible air supply tube 210 (shown in FIG. 3) via air output tube-2 292 (shown in FIG. 4). This air supply also begins at the start of an inflation cycle and rises to preset, therapeutic air pressure 484.

Preset therapeutic air pressures 454 and 484 are approximately equal to maximum (MAX) desired pressures 456 and 486, and minimum (MIN) desired therapeutic pressures 455 and 485, respectively (shown by dashed lines). Pressures above MAX or below MIN levels will cause digital display air pump 130 to signal an alarm of high or low pressure, respectively.

An absolute air pressure (ABS MAX) is an overall maximum pressure 468 and 498 (shown by dashed lines) that corresponds to an absolute maximum allowed pressure within deep vein thrombosis prevention garment 100 and 200, respectively, the maximum pressure medically safe, or any other maximum value utilized in the art to ensure safe operation of the digital display air pump 130 of the present invention. ABS MAX 468 and 498 are air pressure set points above which the digital display air pump 130 of the present invention signals an alarm of over pressure.

With single garment switch 141 pressed to select single garment mode, the inflation/deflation cycle of the deep vein thrombosis prevention garment 100 follows the graph shown in FIG. 5.

When dual garment switch 142 is turned on to select dual garment mode the inflation and deflation of garments 100 and 200 proceeds as follows with inflation beginning first with air output tube-1 192 and garment 100.

Looking at graph 450, the inflation cycle is complete once the deep vein thrombosis prevention garment 100 has had sufficient time to inflate, and is designated by time period 470. Following the inflation cycle, a delay 258 may be inserted at the end of time period 470, as described in FIG. 5, but is not represented here.

Following inflation, the deflation cycle begins, and the pressure 462 in the system of air output tube-1 192 and garment 100 decreases to zero during time period 472. Simultaneously, the system of air output tube-2 292 and garment 200 begins inflation as shown by curve 482 in graph 480. This inflation cycle is completed when air pressure in deep vein thrombosis prevention garment 200 reaches therapeutic level 484 at the end of time period 472.

A delay 473 in graph 450 occurs naturally between the end of garment 100 deflation and the beginning of its next inflation cycle shown by curve 453 in time period 474. This delay 473 exists as the time differential between garment 100 ending its deflation cycle and garment 200 finishing its inflation cycle, and is variable depending upon set timing parameters.

During time period 474, as garment 100 is in its next inflation cycle, garment 200 begins its deflation cycle and pressure 492 returns to zero. Again, as shown on graph 480, a delay 476 occurs between the end of the garment 200 deflation cycle and completion of the garment 100 inflation cycle shown by curve 453.

While there have been shown what are presently considered to be preferred embodiments of the present invention, it will be apparent to those skilled in the art that various changes and modifications can be made herein without departing from the scope and spirit of the invention.

We claim:

1. A digital display air pump comprising:

a body;

an air compressor located within the body;

a first air output port and a second air output port;

an electromechanical switching valve configured to switch air supplied by the air compressor to the first air output port or the second air output port;

a controller, a processor, and a memory, the memory storing program information including a minimum therapeutic air pressure, a target therapeutic air pressure, and a maximum therapeutic air pressure, the processor having instructions operative to instruct the controller to:

direct the compressor to output air through the first and second air output ports during first and second inflation cycles so that air pressure inside first and second compression garments reaches first and second output air pressures, respectively;

direct the compressor to change but not cease its output and thereby fluctuate the first output air pressure inside the first compression garment between the minimum and maximum therapeutic air pressures, such that the first output air pressure remains in a first therapeutic air pressure zone; and direct the compressor to change but not cease its output and thereby fluctuate the second output air pressure inside the second compression garment between the minimum and maximum therapeutic air pressures, such that the second output air pressure remains in a second therapeutic air pressure zone, wherein the processor has instructions operative to direct the compressor to oscillate the first output air pressure between the minimum and maximum therapeutic air pressures during the first inflation cycle and oscillate the second output air pressure between the minimum and maximum therapeutic air pressures during the second inflation cycle.

2. The digital display air pump of claim 1, further comprising a user-operated control on the body configured to interface with the controller and, in response to a user input, change the target therapeutic air pressure between different user-selected set points.

3. A compression system comprising the digital display air pump of claim 1, a first output tube fluidly connected to the first air output port and the first compression garment, and a second output tube fluidly connected to the second air output port and the second compression garment.

4. The digital display air pump of claim 1, further comprising one or more user-operated controls on the body configured to interface with the controller and, in response to a user input, place the air pump into a single garment or a dual garment mode, wherein in the single garment mode, the processor supplies instructions to the controller operative to proceed with, exclusively, the first inflation cycle and a first deflation cycle or the second inflation cycle and a second deflation cycle, and wherein in the dual garment mode, the processor supplies instructions to the controller operative to proceed with both the first and second inflation and deflation cycles.

5. The digital display air pump of claim 4, wherein, in the dual garment mode, the processor supplies instructions to the controller operative to:

direct the compressor to cause the pump to undergo the first inflation cycle for the first air output port; and during the first deflation cycle, direct the compressor to cause the pump to undergo the second inflation cycle for the second air output port.

6. The digital display air pump of claim 5, wherein during the first deflation cycle, the electromechanical switching valve is configured to be in a position that recycles air entering into the first air output port and sends the air to the second air output port.

7. The digital display air pump of claim 1, further comprising a timer configured to set a period for the first and second inflation cycles and for first and second deflation cycles, a duration of inflation and deflation during the first and second deflation cycles, and a duration of time at which the first and second therapeutic air pressure zones is maintained.

8. The digital display air pump of claim 1, further comprising a pressure sensor and an alarm, wherein the memory stores program information defining maximum and minimum air pressure alarm levels, the alarm being configured to issue an alarm when the pressure sensor reads above the maximum air pressure alarm level or below the minimum air pressure alarm level.

9. A therapeutic compression method comprising:

providing a digital display air pump comprising a compressor, a controller, a pressure sensor, and a first air output port;

positioning a first compression garment having an inflatable bladder around a body structure of a patient;

actuating the compressor to output air out of the first air output port to a first output tube fluidly connected to the first air output port and the inflatable bladder so that the inflatable bladder of the first compression garment is inflated;

inflating the inflatable bladder using the compressor so that air pressure inside the inflatable bladder is within a therapeutic air pressure zone, the therapeutic air pressure zone being defined by a minimum and maximum therapeutic air pressure;

monitoring the air pressure inside the inflatable bladder using the pressure sensor; and in response to readings from the pressure sensor, oscillating air output out of the compressor and through the first air output port so that the air pressure inside the inflatable bladder oscillates between the minimum and maximum therapeutic air pressures.

10. The method of claim 9, wherein the digital display air pump further comprises an alarm, and the method further comprises sensing the air pressure inside the inflatable bladder using the pressure sensor and issuing an alarm using the alarm if the air pressure inside the inflatable bladder is outside of pre-set alarm levels.

11. The method of claim 9, wherein the digital display air pump further comprises a timer, and the method further comprises controlling a length of time it takes for the first compression garment to go through a first inflation cycle and a first deflation cycle.

12. The method of claim 9, wherein the digital display air pump further comprises a second air output port, and the method further comprises:

providing a second compression garment with an inflatable bladder and a second air output tube fluidly connected to the second air output port;

deflating the inflatable bladder of the first compression garment after inflating the first compression garment's bladder;

during deflation of the inflatable bladder of the first compression garment, causing air coming from the inflatable bladder of the first compression garment to be recycled and used to inflate the inflatable bladder of the second compression garment; and actuating the compressor to output air out of the second air output port and inflate the inflatable bladder of the second compression garment.

13. The method of claim 9, wherein the therapeutic air pressure, zone is further defined by a target therapeutic air pressure and the method further comprises actuating a user-input control of the digital display air pump to change the target therapeutic air pressure according to a user's need.

* * * * *